United States Patent [19]

Tahara et al.

[11] Patent Number: 4,975,147

[45] Date of Patent: Dec. 4, 1990

[54] METHOD OF PRETREATING METALLIC WORKS

[75] Inventors: Masaaki Tahara, Takatsuki; Takakazu Tomoda, Osaka; Kenzo Kitano, Kawachinagano, all of Japan

[73] Assignee: Daidousanso Co., Ltd., Osaka, Japan

[21] Appl. No.: 483,709

[22] Filed: Feb. 23, 1990

[30] Foreign Application Priority Data

Dec. 22, 1989 [JP] Japan ..... 1-333424

[51] Int. Cl.[5] ..... B44C 1/22; C03C 15/00; C03C 25/06; B29C 37/00

[52] U.S. Cl. ..... 156/646; 134/31; 156/655; 156/656; 156/664; 156/665

[58] Field of Search ..... 156/646, 655, 656, 665, 156/664, 668; 134/31, 38, 39, 40

[56] References Cited

U.S. PATENT DOCUMENTS 3,518,132 6/1970 Glendinning ..... 156/646

4,325,984 4/1982 Galfo et al. ..... 156/646 X

*Primary Examiner*—William A. Powell

*Attorney, Agent, or Firm*—Armstrong, Nikaido Marmelstein, Kubovcik & Murray

[57] ABSTRACT

The primary object of the invention is to clean and activate the surface of metallic works prior to such thermal treatment as nitriding, thermal spraying or dip plating by removing oxidized and other passive layers and foreign matters from the metallic work surface.

The method of pretreating metallic works comprises heating a metallic work in a furnace and introducing a fluorine- or fluoride-containing gas into the furnace in that state to thereby cause destruction and elimination of the foreign matters adhering to the metallic work surface and of the oxidized layer occurring on the metallic work surface and simultaneous formation of a fluorinated layer. Just prior to the main thermal treatment, for example nitriding, the fluorinated layer is decomposed and eliminated by introducing an appropriate gas, for example $H_2$, into the furnace. In this way, the metallic work reveals its cleaned and activated surface.

3 Claims, 5 Drawing Sheets

METHOD OF PRETREATING METALLIC WORKS

FIELD OF THE INVENTION

This invention relates to a method of pretreating metallic articles or works for the purpose of cleaning and activating the surface thereof prior to (1) diffusion/penetration processing, such as boronizing, carburization or nitriding, (2) hard ceramic coating formation, for example by physical vapor deposition or thermal spraying, or (3) plating, for example by hot dipping in a molten aluminum or zinc bath.

BACKGROUND OF THE INVENTION

Prior to being subjected to thermal diffusion/penetration treatment, coating treatment to form hard ceramic coatings, plating treatment or the like thermal surface treatment, metallic works made of steel, aluminum, titanium or nickel, for instance, are generally subjected to various types of pretreatment, for example cleaning, degreasing, acid pickling and treatment with a molten flux. Thus, for example, alkali degreasing and/or cleaning with an organic solvent is selectively applied to carbon steel works before such thermal treatment as carburization or nitriding. For nitriding or the like thermal treatment of stainless steel works, a step of removing surface oxidized layers by washing with a hydrofluoric acid-nitric acid mixture is added to the above-mentioned pretreatment step or steps. In the case of such thermal treatment as physical vapor deposition (PVD) or chemical vapor deposition (CVD) for forming hard ceramic coating layers, such intermediate processing as nickel plating is conducted as a pretreatment step in some instances for improving the adhesion of coating layers to substrate metallic works. For such thermal treatment as plating treatment in a molten zinc or aluminum bath, substrate works are pretreated with a molten flux following degreasing and acid pickling to thereby realize an increased surface activity, or substrate works are maintained at a temperature above the contemplated thermal treatment temperature for a certain period of time and then gaseous hydrogen or a gas containing a high concentration of hydrogen is introduced into the system for reducing the substrate work surface in the resulting reducing atmosphere to achieve the same purpose. The primary object of these pretreatment processes is to activate the surface of substrate metallic works to thereby facilitate the thermal treatment proper and produce maximum treatment effects. However, recent regulations against waste water discharge, regulations against the use of fluorocarbon species, aggravated working conditions and other factors have made it difficult to continue the commercial use of most of the above-mentioned pretreatment processes and have caused increases in pretreatment cost year by year. Furthermore, the pretreatment process comprising maintaining substrate steel works in a reducing gas atmosphere at an elevated temperature prior to plating treatment using molten zinc or aluminum not only requires an expensive reducing gas in large quantities but also involves the problem that the efficiency of plating is impaired by selective oxidation of valuable elements contained in steel materials, for example Mn, Si and Al. It is not easy to maintain such elements in a completely reduced state in the temperature range not higher than 780° C. as compared with Fe, Zn and the like; such elements are susceptible to oxidation and are readily oxidized in the temperature range of about 500°–600° C.

As a result, there arises the above-mentioned problem, namely the plating efficiency decreases due to oxidation.

As mentioned hereinabove, the prior art pretreatment processes to be applied to substrate metallic works before the subsequent thermal treatment proper still encounter such problems as increases in pretreatment cost, environmental pollution problems and deterioration of performance characteristics of metallic materials themselves. Solution of these problems is earnestly desired.

OBJECTS OF THE INVENTION

Accordingly, it is an object of the invention to provide a method of pretreating metallic works for cleaning and activate the surface thereof to thereby facilitate the succeeding thermal treatment proper, without causing environmental pollution or increases in pretreatment cost and without impairing performance characteristics of metallic materials.

SUMMARY OF THE INVENTION

To accomplish the above and other objects, the invention provides a method of pretreating metallic works which comprises holding a metallic work in a heated condition in a fluorine- or fluoride-containing gas atmosphere and then removing the resulting fluorinated layer to thereby clean and activate the surface of said metallic work.

DETAILED DESCRIPTION OF THE INVENTION

Figure 1:
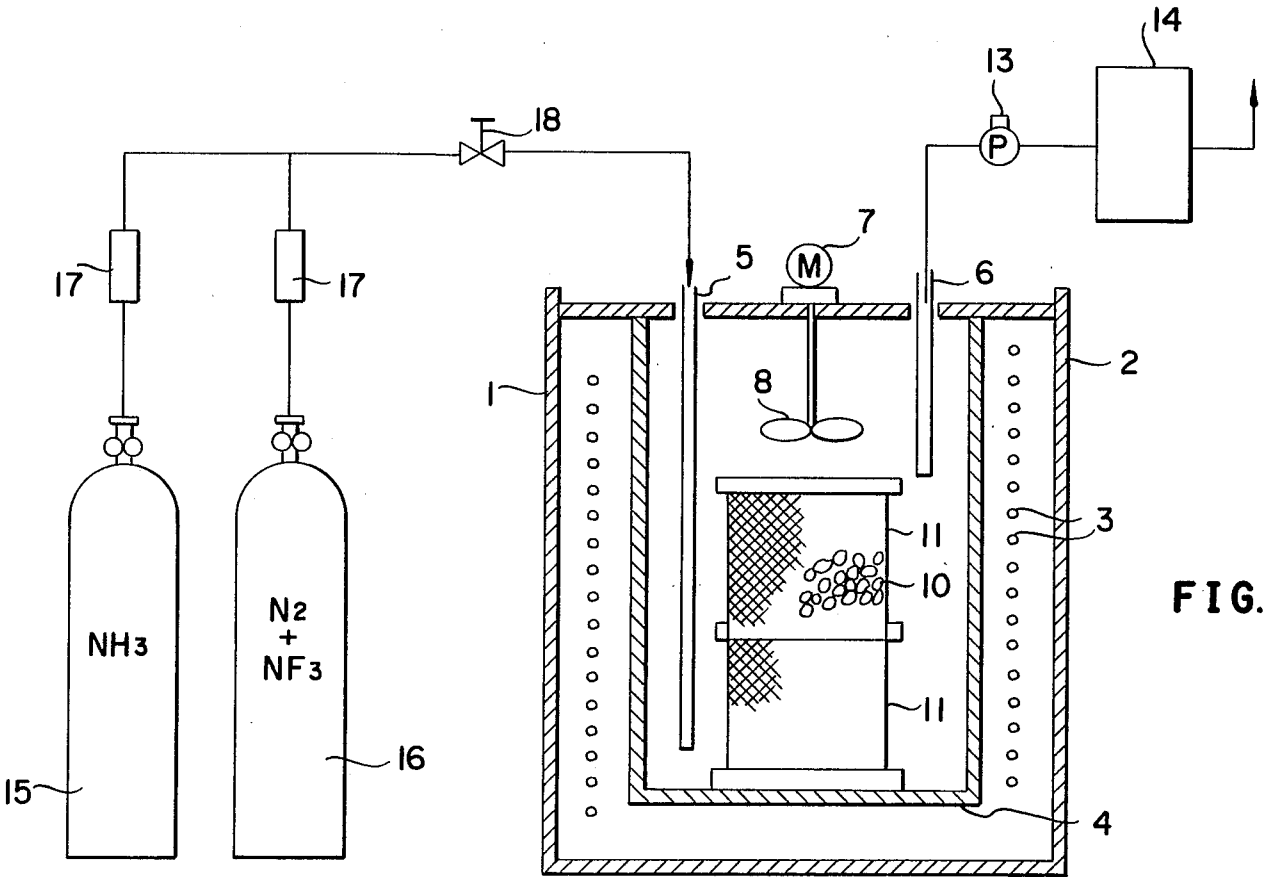
FIG. 1 schematically shows, in cross section, an example of the treatment furnace for use in the practice of the invention.

As a result of a series of investigations made by the present inventors in an attempt to develop a method by which the surface of metallic works can be perfectly cleaned and at the same time activated, it has been found that when metallic works are heated in a furnace and, at an elevated temperature thus attained, their surface is brought into contact with a fluorine- or fluoride-containing gas introduced into said furnace, the resulting activated fluorine atoms decompose and remove from said surface foreign matters adhering thereto, for example processing aids, and thus clean said surface and, at the same time, the oxide layer on the metallic work surface is removed and instead a fluorinated layer is formed and protects said surface. Where $H_2$ and $H_2O$ are absent, this fluorinated layer is stable and continues covering and protecting the metallic work surface at temperature of about 300°–600° C. Such fluorinated layer is formed on the furnace inside wall surface as well and covers and protects said wall surface, so that corrosion and wear of the furnace inside wall surface can be prevented.

In addition to the above-mentioned fluorine- or fluoride-containing gases, there are also available chloride gases, such as $CH_3Cl$ (chloromethane) and HCl (hydrogen chloride). However, these chloride gases react with metallic works to give such chloride compounds as $FeCl_2$, $CrCl_2$ and $CrCl_3$. Since these reaction product chlorides are highly sublimable as compared with the corresponding fluorides, showing, for instance, a 100 thousand-fold higher vapor pressure, the so-called chromium (Cr) deficiency (loss of Cr atoms as $CrCl_2$ from the metal work surface layer and the resulting Cr shortage and marked decreases in corrosion resistance and so on) may result and, in addition, chloride-containing gases resulting from vaporization of the above-mentioned readily vaporizable chlorides will erode the furnace inside wall surface and increase the wear thereof. Therefore, they are not suited for practical use.

In accordance with the invention, the oxidized layer occurring on the metallic work surface is removed and a fluoride layer is formed instead. This fluoride layer covers and protects the metallic work surface. Such effects of the invention are particularly significant when the subsequent thermal treatment is conducted at a temperature not higher than 700° C. The reason is as follows. Metal elements, such as Cr, Mn, Si and Al, contained in metallic works, for example steel works, are readily oxidizable in the above temperature range. Since it is difficult to produce an atmosphere in which these metal elements can remain perfectly neutral or reducing, the metal elements mentioned above are mostly oxidized in the above temperature range and intergranular oxides are formed on the metal work surface in the step of thermal treatment proper and serve as obstacles to the intended thermal treatment. In accordance with the invention, metallic works are submitted to each intended thermal treatment, with their surface protected with a fluorinated layer and, therefore, any problem of the above kind will not arise.

The fluorinated layer covering and protecting the metallic work surface in the above manner can be eliminated, prior to the step of thermal treatment proper, by, for example, introducing into the furnace, which is maintained at a temperature of about 480°–700° C., an $H_2$-containing gas, such as an $H_2$-containing inert gas or a mixture of a nitrogen source gas (e.g. $NH_3$ gas) and $H_2$ to thereby cause destruction of the fluorinated layer by means of $H_2$ contained in said gas. In this manner, the original surface, now clean and active, appears, and a hard coating, for instance, is formed thereon with good adhesion in the subsequent thermal treatment step.

In the following, the invention is described in more detail.

In accordance with the invention, the metallic work surface is subjected to pretreatment with a fluorine- or fluoride-containing gas.

The term "fluorine- or fluoride-containing gas" as used herein means a dilution of at least one fluorine source component selected from the group consisting of $NF_3$, $BF_3$, $CF_4$, HF, $SF_6$ and $F_2$ in an inert gas such as $N_2$. Among the above-mentioned fluorine source compounds, $NF_3$, $BF_3$, $CF_4$ and $F_2$ are gaseous at ordinary temperature while $SF_6$ occurs as a liquid at ordinary temperature. They are admixed, either singly or in combination, with an inert gas, such as $N_2$, to give fluorine- or fluoride-containing gases to be used in the practice of the invention. Among the fluorine source components mentioned above, $NF_3$ is most suited for practical use since it is superior in safety, reactivity, controlability, ease of handling and other aspects to the other. $F_2$ is not so preferable since it has extremely high reactivity and toxicity, is inferior in ease of handling and makes it difficult to operate the furnace smoothly. Generally, the fluorine- or fluoride-containing gases are used in an elevated temperature atmosphere and, therefore, even the fluorine source component $SF_6$, which is liquid at ordinary temperature, is vaporized and mixed with the inert gas under the conditions of use. From the efficacy viewpoint, the fluorine- or fluoride-containing gases should contain the fluorine source components, such as $NF_3$, in a concentration within the range of 0.05% to 20% (on the weight basis; hereinafter the same shall apply), preferably 2% to 7%, more preferably 3% to 5%.

As examples of the metallic works that can be pretreated in accordance with the invention, there may be mentioned steel works, aluminum works, titanium works and nickel works. Said steel works include works made of various steel species, for example carbon steel and stainless steel. The metallic works may vary in shape or form and in dimensions. Thus, for example, they may be in the form of plates or sheets, coils, screws or some other machined articles. The metallic works to which the method of the invention is applicable may be made not only of one of such metallic materials as mentioned above but also of an alloy derived from the above-mentioned materials by appropriate combination, with or without addition of another or other minor component metallic materials.

In accordance with the invention, the metallic works mentioned above are pretreated, for example, as follows. The metallic works are placed in a heating furnace and heated to a temperature of 150°–600° C., preferably 300°–500° C. Then, in that state, a fluorine- or fluoride-containing gas is introduced into the heating furnace. The metallic works are held at the above-mentioned temperature in an fluorine- or fluoride-containing gas atmosphere for about 10–120 minutes, preferably about 20–90 minutes, more preferably 30–60 minutes, whereby the oxidized layer on the metallic work surface is removed and a fluorinated layer is formed on said surface. An $H_2$-containing inert gas is then introduced into the heating furnace for decomposing and eliminating the fluorinated layer. As a result, a cleaned and activated metallic material surface reveals itself. This series of steps may be performed, for example, in a heat treatment furnace 1 such as the one shown in FIG. 1. In the figure, the furnace 1 is a pit furnace and has a heater 3 provided in the space between an outer shell 2 and an inner vessel 4, with a gas inlet pipe 5 being inserted in said vessel. Gas supply is made from cylinders 15 and 16 via flow meters 17 and a valve 18. The inside atmosphere is stirred by means of a fan 8 driven by a motor 7. Works 10 placed in a wire net container 11 are charged into the furnace 1. The furnace is provided with an exhaust pipe 6, a vacuum pump 13 for exhaustion, and a noxious substance eliminator 14.

In this heat treatment furnace 1, the pretreatment procedure is carried out as follows. The metallic works 10 charged in the furnace 1 as shown in FIG. 1 are heated by means of the heater 3 to a predetermined temperature. A fluorine- or fluoride-containing gas, for example a mixed gas composed of $NF_3$ and $N_2$, is introduced into the furnace 1 from the cylinder 15, whereby processing aids and the like adhering to the surface of the metallic works 10 are removed and at the same time the oxidized layer possibly occurring on the surface of the metallic works 10 is removed and a fluorinated layer is formed instead. As a result, the surface of the metallic works 10 is covered and protected by the fluorinated layer. After such pretreatment of the metallic works 10 in the furnace 1, the fluorine- or fluoride-containing gas in the furnace 1 is discharged from the furnace through the exhaust pipe 6 by applying vacuum. The metallic works 10 are then heated by the heater 3 to a further elevated temperature of 480°–700° C. In that state, a mixed gas composed of $N_2$ and $H_2$ is blown into the furnace from the cylinder 16, whereby the fluorinated layer is eliminated. As a result, the metallic works 10 reveal a clean and active metallic surface. This surface undergoes various kinds of treatment process in the subsequent thermal treatment step. In this case, thermal treatment proper, for example diffusion/penetration treatment, can be applied to the surface of the metallic works 10 deeply and uniformly, since said surface has now been cleaned and activated. In hard ceramic coating or plating, a uniform and closely adhering coating layer or metal deposit layer can be formed. The fluorinated layer may be eliminated simultaneously with thermal treatment proper.

When nitriding treatment is performed as the subsequent thermal treatment, an extremely hard compound layer (nitrided layer) containing such nitrides as CrN, $Fe_2N$, $Fe_3N$ and $Fe_4N$ is formed uniformly and deeply from the surface of the metallic works 10 toward the inside thereof. Therebelow a hard N atom diffusion layer is formed deeply. Such mode of nitriding is very efficient. However, as mentioned hereinbefore, the subsequent thermal treatment is not limited to such nitriding. For instance, the method of the invention is effective in performing such processing treatments as carbonitriding, physical vapor deposition (PVD) and chemical vapor deposition (CVD), which are to be carried out at or below 700°. In these cases, the pretreatment for fluorinated layer formation should preferably be conducted in a furnace other than the furnace in which the thermal treatment proper is carried out. Other examples of the subsequent thermal treatment for which the method of the invention is effective are plating treatments using molten zinc or aluminum. While these treatments generally include a complicated series of steps, namely alkali degreasing, acid pickling, molten flux treatment and dipping in molten aluminum or zinc, the pretreatment stage from alkali degreasing to molten flux treatment can be markedly simplified when the method of pretreatment according to the invention is employed. As a result, the length of the overall process can be shortened and the production cost can be reduced. Furthermore, particularly in plating works made of a high Si content steel species, the method of the invention can produce a favorable effect in that a metal deposit layer superior in adhesion can be formed.

As mentioned above, the method of this invention comprises holding metallic works in a heated state in a fluorine- or fluoride-containing gas atmosphere so that active fluorine atoms supplied by the fluorine- or fluoride-containing gas can act on the metallic work surface, cleaning the same by destructing and eliminating processing aids and other foreign matters adhering thereto and at the same time removing the surface oxidized layer therefrom and forming a fluorinated layer instead. This fluorinated layer can serve as a protective coating on the surface of the metallic works. The fluorinated layer can be decomposed and eliminated in a step just prior to or in the subsequent thermal treatment step by means of an $H_2$-containing gas, whereby an uncoated and activated metallic work surface can appear. Although a certain period of time may be required from the pretreatment to the thermal treatment, the method of this invention does not cause the unfavorable phenomenon that a new oxidized layer is formed on the pretreated metallic work surface. This is because the fluorinated layer formed after removal of the oxidized layer from the metallic work surface covers and protects said surface. Thus, in accordance with the invention, the oxide layer on the metallic work surface is converted to a fluorinated layer, which can be readily decomposable and removable, so that the metallic work surface can be converted to an uncovered and activated state. This is an outstanding feature of the invention.

BEST MODES FOR CARRYING OUT THE INVENTION

EXAMPLE 1

[Pretreatment]

SUS 305 tapping screws (samples) were shaped and then cleaned with vaporized trichloroethylene. They were charged into such a furnace 1 as shown in FIG. 1 and heated to a temperature of 350° C. In that state, a fluoride-containing gas composed of 7.0% of $NF_3$ and +93.0% of $N_2$ was introduced into the furnace 1 and the resulting system was maintained at 350° C. for 20 minutes. Then, some of the above-mentioned samples were taken out and examined for their surface structure. It was confirmed that a fluorinated layer had been formed all over the surface.

[Thermal treatment]

The samples remaining in the furnace 1 were heated to 550° C., held in an $N_2$+90% $H_2$ atmosphere for 30 minutes and then subjected to 5 hours of nitriding treatment by introducing into the furnace 1 a mixed gas composed of 50% $NH_3$, 10% $CO_2$ and 40% $N_2$. In this treatment process, the fluorinated layer was decomposed and eliminated and at the same time a nitrided layer was formed. The thus-nitrided samples were air-cooled and taken out of the furnace.

A uniform nitrided layer had been formed on the surface of the samples obtained.

COMPARATIVE EXAMPLE 1

The same tapping screw samples as used in Example 1 were cleaned with vaporized trichloroethylene, pretreated by dipping in a hydrofluoric acid-nitric acid mixture for 30 minutes, charged into the same furnace 1 as used in Example 1, and subjected to nitriding treatment in a mixed gas composed of 50% $NH_3$ and 50% RX ($H_2$, CO) for 5 hours.

Figure 2:
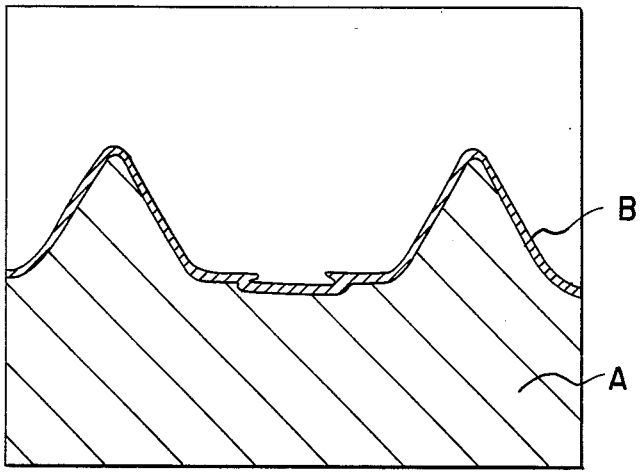
FIG. 2 is a schematic representation of a crosssectional photomicrograph (magnification: 50) of a surface layer portion of a work pretreated by the method of the invention and then subjected to thermal treatment (nitriding) in Example 1.
Figure 3:
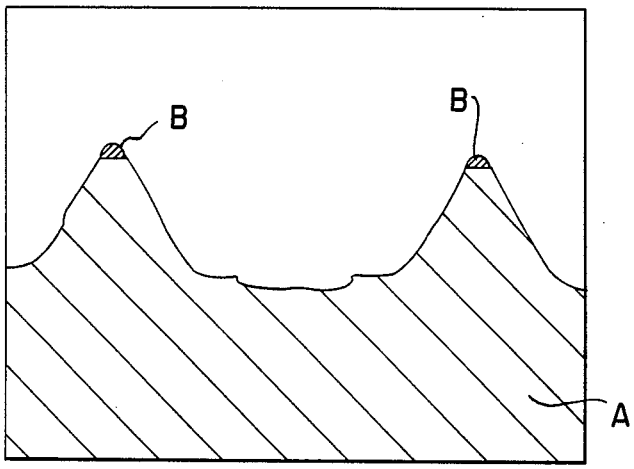
FIG. 3 is a schematic representation of a crosssectional photomicrograph (magnification: 50) of a surface layer portion of a work pretreated and then subjected to thermal treatment (nitriding) as described in Comparative Example 1.
Figure 4:
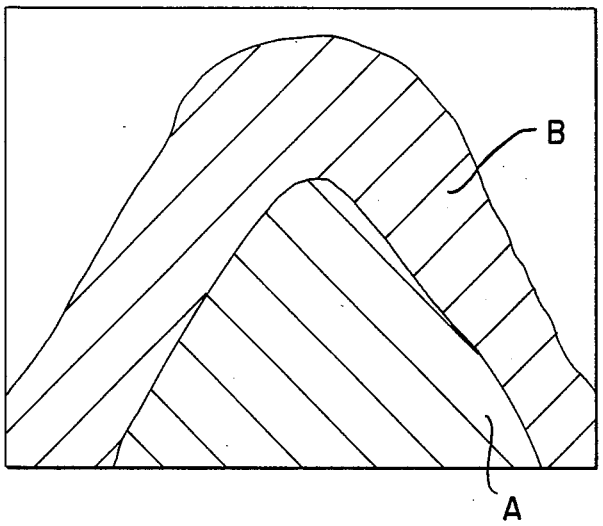
FIG. 4 is a schematic representation of a crosssectional electron micrograph (magnification: 500) of a portion of the thread ridge of a work pretreated and nitrided as described in Example 1.

The samples obtained in Example 1 were compared with those obtained in Comparative Example 1 with respect to the state of the nitrided layer and to the hardness distribution. The results are summarized below in tabular form. The sectional photomicrographic views (magnification: 50) of the samples obtained in Example 1 and Comparative Example 1, respectively taken in the vicinity of the surface, are schematically shown in FIG. 2 and FIG. 3, respectively. The sectional electron micrographic view (magnification: 500) of the thread of a sample obtained in Example 1 is schematically shown in FIG. 4. In FIGS. 2-4, the letter A indicates the base metal and B the nitrided layer.

| | Example 1 | Comparative Example 1 |
|---|---|---|
| State of nitrided layer | Nitrided layer uniform in thickness formed all over the surface. | No nitrided layer formation in many parts; nitrided layer, if formed, found only in thread top portions. |
| Hardness: | | |
| Surface hardness of nitrided layer B (Hv) | 1150–1200 | 310–320 |
| Hardness of the inside (base metal) A (Hv) | 270–290 | 270–290 |

EXAMPLE 2

[Pretreatment]

Figure 5:
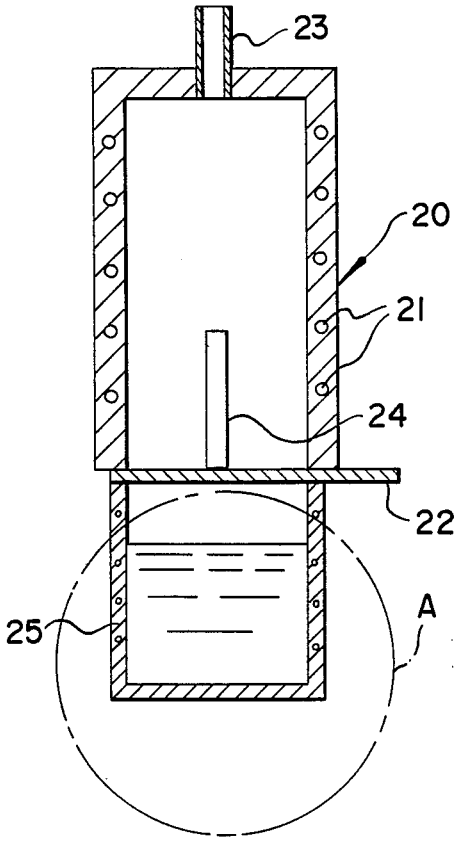
FIG. 5 schematically shows, in cross section, another example of the furnace to be used in the practice of the invention.
Figure 6:
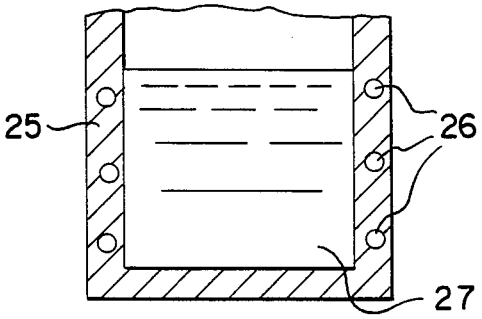
FIG. 6 is an enlargement of the circled portion A of FIG. 5.

A fragment of a very low carbon steel strip (Si content: 1.5%; Mn content: 0.5%) was used as a sample. The sample was cleaned by alkali degreasing, washed with water and charged into a furnace as shown in FIG. 5. In FIG. 5, the furnace body 20 including its heat insulating wall has a heating means 21 circumferentially embedded in the furnace body 20. A sliding door 22 closes the bottom of the furnace body 20 is slidable in the left and right directions in the plane shown. The ceiling of the furnace body 20 is equipped with a gas inlet pipe 23 which enables gas introduction into the furnace body 20 containing the sample 24 to be treated. A zinc pot furnace 25 is disposed below the furnace body 20, with the sliding door 22 serving as a partition therebetween. As shown in FIG. 6, the zinc pot furnace 25 has an induction coil 26 embedded in the surrounding wall and contains a zinc bath 27 maintained at 450° C. The sample charged in such a furnace was heated to 300° C. and then held, for pretreatment, at that temperature in a mixed gas composed of 1% $NF_3$ and 99% $N_2$ as introduced into the furnace for 30 minutes. The sample was then heated to 500° C. and held in a mixed gas (75% $N_2$+25% $H_2$) introduced into the furnace for 10 minutes, whereby the fluorinated layer formed in the pretreatment was eliminated.

[Thermal treatment]

The sliding door 22 was opened and the sample was transferred to the zinc pot furnace 25 and zinc-plated there. The sample was then taken out of the furnace, whereupon $N_2$ gas was blown against the sample. The sample was then cooled and dried. Thus was obtained a desired zinc-plated sample.

COMPARATIVE EXAMPLE 2

A fragment of the same very low carbon steel strip as used in Example 2 was cleaned by alkali degreasing, acid pickling and washing with water, then charged into the furnace shown in FIG. 5, and heated to 700° C. In that state, a mixed gas composed of 25% $N_2$ and 75% $H_2$ was blown into the furnace for 20 minutes. Then, the sliding door 22 was opened and the sample fragment was transferred to the zinc pot furnace situated below the furnace 20 and subjected to zinc plating under the same conditions as used in Example 2, followed by blowing $N_2$ gas against the sample, cooling and drying.

The thus-obtained two steel samples were tested for the adhesion of the zinc metal deposit layer by performing a bending test followed by observation of the bent portion. The sample of Comparative Example 2 which had been heated at 700° C. showed marked insufficiency of metal deposit layer adhesion in places. On the contrary, the sample of Example 2 did not show such a phenomenon. The samples of Example 2 and Comparative Example 2 were subjected to surface analysis by means of an optical microscope, an X ray microanalyzer (EPMA) and an ion microanalyzer (IMA). Selective oxidation to $Si_mO_n$ and $Mn_mO_n$ was observed with the sample of Comparative Example 2 while such phenomenon was not found in the sample of Example 2.

EXAMPLE 3

[Pretreatment]

An SKH 51 end mill was used as a sample. This was degreased, dried, further subjected to fluorocarbon cleaning and then charged into the furnace shown in FIG. 1. The furnace was evacuated to $10^{-2}$ to $10^{-3}$ torr using a vacuum pump while the furnace inside temperature was raised. Then, the temperature was maintained at 280° C. and the pressure at 150 to 200 torr. In that state, a mixed gas composed of 20% $NF_3$ and 80% $N_2$ was introduced into the furnace The sample was held in that state in the mixed gas for 30 minutes, the furnace was then cooled, and the sample was taken out.

[Thermal treatment]

Figure 7:
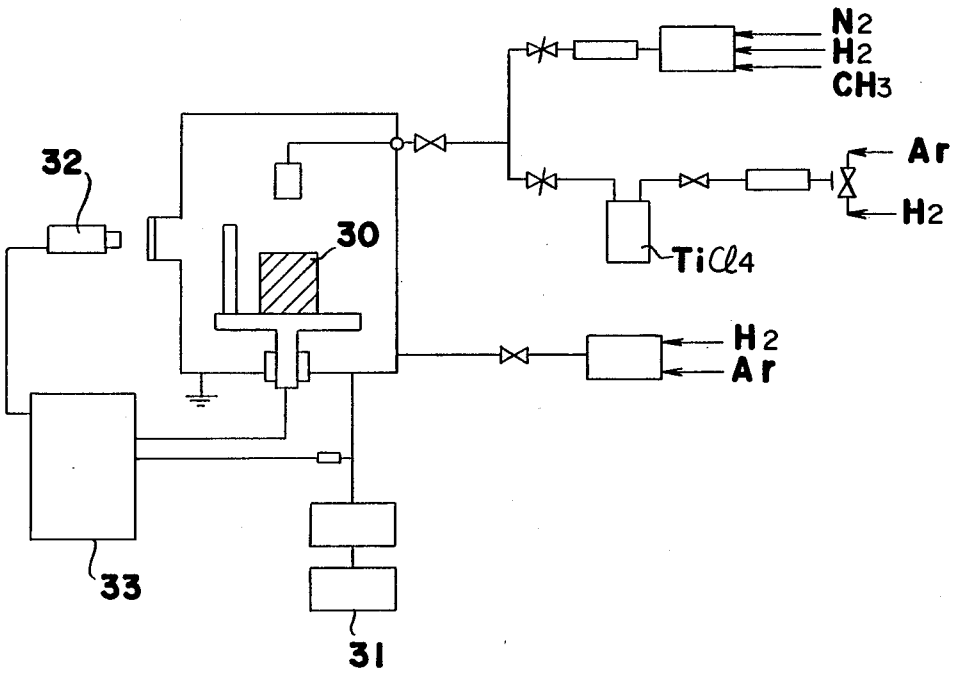
FIG. 7 schematically shows, in cross section, a plasma CVD furnace suited for use in the practice of the invention.

The thus-pretreated sample was placed in such a low temperature plasma CVD furnace as shown in FIG. 7 and subjected to TiN coating by heating at 480° C. for 60 minutes. In FIG. 7, the reference numeral 30 stands for the sample, 31 for a pump, 32 for a thermometer and 33 for a power source.

The TiN coating layer on the thus-obtained sample had a thickness of 3 μm. The adhesion of this coating layer as measured on a scratch tester was higher by 30% as compared with the adhesion attainable by the plasma CVD technique using the conventional pretreatment methods. The durability of the sample end mill was at least 5 times higher as compared with an uncoated sample.

What is claimed is:

1. A method of pretreating metallic works which comprises holding a metallic work in a heated condition in a fluorine- or fluoride-containing gas atmosphere and then removing the resulting fluorinated layer to thereby clean and activate the surface of said metallic work.

2. A method of pretreating metallic works as claimed in claim 1, wherein said metallic work is made essentially of steel, aluminum, titanium or nickel.

3. A method of pretreating metallic works as claimed in claim 1 or 2, wherein the fluorine- or fluoride-containing gas is a dilution, in an inert gas, of at least one fluorine source component selected from the group consisting of $NF_3$, $BF_3$, $CF_4$, HF, $SF_6$ and $F_2$.

* * * * *